US010974369B2

(12) United States Patent
Tan

(10) Patent No.: US 10,974,369 B2
(45) Date of Patent: Apr. 13, 2021

(54) DRIVING TOOL

(71) Applicant: Yu-Tung Tan, Taichung (TW)

(72) Inventor: Yu-Tung Tan, Taichung (TW)

( * ) Notice: Subject to any disclaimer, the term of this patent is extended or adjusted under 35 U.S.C. 154(b) by 321 days.

(21) Appl. No.: 16/234,034

(22) Filed: Dec. 27, 2018

(65) Prior Publication Data

US 2020/0206881 A1 Jul. 2, 2020

(51) Int. Cl.

| | |
|---|---|
| ***B25B 13/46*** | (2006.01) |
| ***B25B 23/16*** | (2006.01) |
| ***B25B 23/00*** | (2006.01) |

(52) U.S. Cl.

CPC ..... *B25B 13/465* (2013.01); *B25B 23/16* (2013.01); *B25B 23/0035* (2013.01)

(58) Field of Classification Search

CPC ..... B25B 13/465; B25B 13/467; B25B 17/00; B25B 23/0035; B25B 23/16

See application file for complete search history.

(56) References Cited

U.S. PATENT DOCUMENTS

| | | | | |
|---|---|---|---|---|
| 6,457,386 | B1 * | 10/2002 | Chiang | B25B 13/465 81/57.29 |
| 6,722,232 | B1 * | 4/2004 | Day | B25B 13/467 81/56 |
| 6,752,045 | B2 * | 6/2004 | Badiali | B25B 13/463 81/57.39 |
| 6,925,910 | B2 * | 8/2005 | Alford | B25B 13/465 81/57.29 |
| 2004/0112180 | A1 * | 6/2004 | Day | B25B 17/00 81/57.28 |
| 2005/0155468 | A1 * | 7/2005 | Chu | B25B 13/465 81/177.8 |
| 2008/0028894 | A1 * | 2/2008 | Maret | B25B 13/463 81/60 |

* cited by examiner

*Primary Examiner* — David B. Thomas

(74) *Attorney, Agent, or Firm* — Muncy, Geissler, Olds & Lowe, P.C.

(57) ABSTRACT

A driving tool includes a housing, a follower assembly at an end of the housing, a driving assembly at another end of the housing, and a pressing handle. The driving assembly includes a first driving member, a second driving member, and a one-way rotation structure between the first driving member and the second driving member.

The pressing handle is engaged with the first driving member to drive it to rotate. The first driving member drives the second driving member to rotate toward a specific direction via the one-way rotation structure. Thereby, the follower assembly is driven to rotate toward a specific direction.

8 Claims, 11 Drawing Sheets

DRIVING TOOL

BACKGROUND OF THE INVENTION

Field of the Invention

The present invention relates to a driving tool.

Description of the Prior Art

A driving tool's two ends are adapted for connecting to workpiece and for a user to pivot. However, it is inconvenient that the user has to detach the driving tool before the next time of pivoting.

To solve the problem, a continuous driving tool as disclosed in patent TW I627028 uses pressing handle and gears connected to the pressing handle to drive the workpiece to rotate indirectly. However, if the workpiece is firmly fixed, the reaction force may damage the gears. Besides, the pressing handle may be pressed accidently to cause danger and reduce service life.

SUMMARY OF THE INVENTION

The main object of the present invention is to provide a driving tool which is labor-saving and efficient. In addition, the driving tool can be used in quick mode or normal mode.

To achieve the above and other objects, the driving tool of the present invention includes a housing, a follower assembly, a driving assembly, a pressing handle, and a toothed rod.

The housing has a first end and a second end opposite to the first end. The housing has a follower zone at the first end and a driving zone at the second end. The follower assembly is arranged in the follower zone and includes at least one follower member. The at least one follower member has a follower toothed portion which is annular and is rotatably disposed on the housing. The driving assembly is arranged in the driving zone and includes a first driving member, a second driving member, and a one-way rotation structure. The first driving member has a first driving toothed portion which is annular. The second driving member has a second driving toothed portion which is annular. The first driving member and the second driving member are rotatably disposed on the housing co-axially. The first driving member is connected to the second driving member via the one-way rotation structure. When the first driving member rotates toward a first direction, the first driving member drives the second driving member to rotate via the one-way rotation structure. When the first driving member rotates toward a second direction opposite to the first direction, the one-way rotation structure prevents the second driving member from being rotated by the first driving member. The pressing handle includes a driving toothed rack. The driving toothed rack is engaged with the first driving toothed portion so that the first driving member is driven to rotate by a movement of the pressing handle. The toothed rod is arranged in the housing to be located between the follower zone and the driving zone. The toothed rod has a first transmission toothed portion and a second transmission toothed portion at two opposite ends thereof wherein the first transmission toothed portion and the second transmission toothed portion are both annular. The first transmission toothed portion is engaged with the follower toothed portion of the at least one follower member so that the toothed rod is able to drive the at least one follower member to rotate. The second transmission toothed portion is engaged with the second driving toothed portion of the second driving member so that the second driving member is able to drive the toothed rod to rotate. A longitudinal direction is defined a line composed of the firs end and the second end of the housing. The housing further defines a vertical direction and a horizontal direction which are perpendicular to the longitudinal direction respectively. The at least one follower member rotates about the vertical direction. The follower toothed portion is disposed on a horizontal face of the at least one follower member. Each of the first driving member and the second driving member rotates about the horizontal direction. The first driving toothed portion is formed on an outer circumferential face of the first driving member. The second driving toothed portion is formed on a vertical face of the second driving member. Each of the first transmission toothed portion and the second transmission toothed portion is annularly formed on the toothed rod about the longitudinal direction. The one-way rotation structure includes a recess and at least one swing member. The recess is formed on a face of the second driving member facing the first driving member. A plurality of notches are formed on a lateral wall of the recess. Each of the notches has a depth increasing toward a circumferential direction and has a blocking wall at a deepest position thereof Each of the blocking walls is parallel to a depth direction of the notch. The at least one swing member is pivotally disposed on a face of the first driving member facing the second driving member. The at least one swing member is received in the recess. When the first driving member rotates toward the first direction, a terminal end of the at least one swing member enters one of the notches to abut against the blocking wall to drive the second driving member to rotate toward the first direction.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
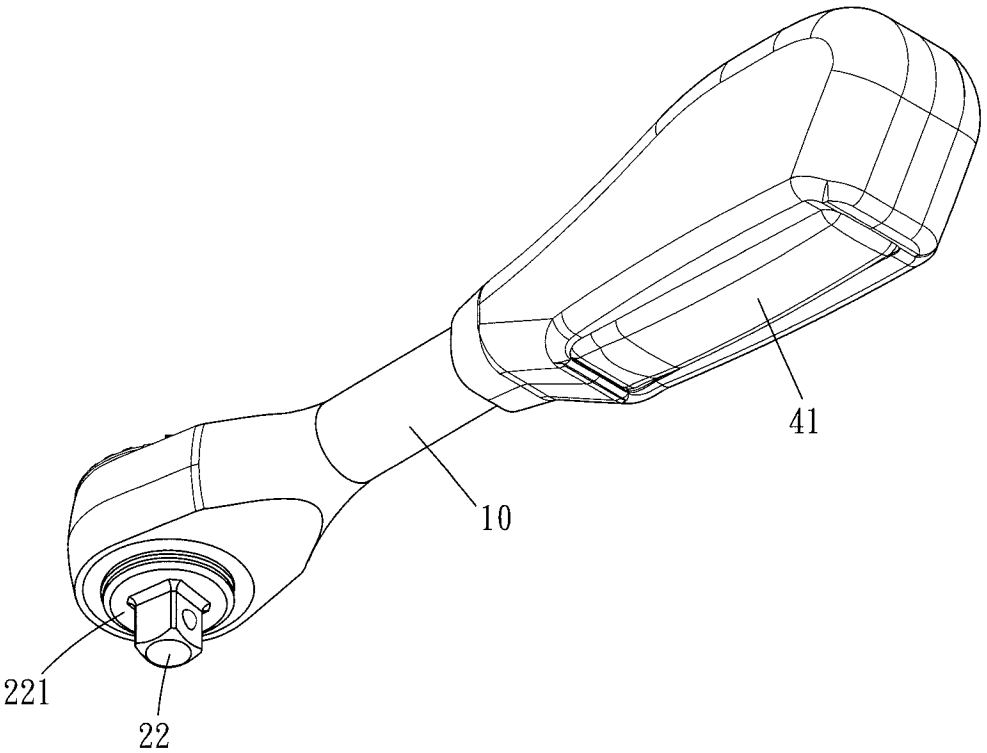
FIG. 1 is a stereogram of the present invention.
Figure 2:
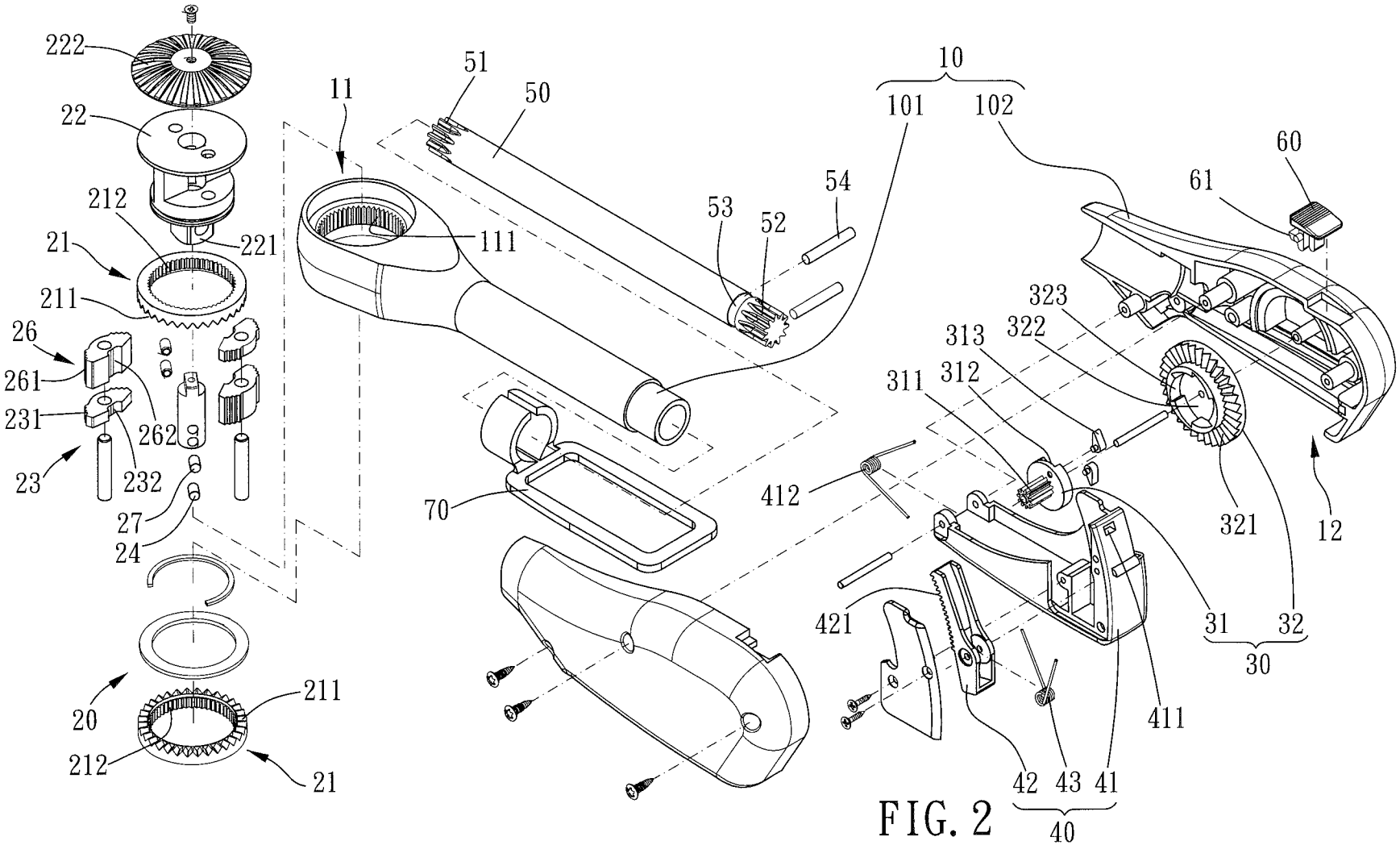
FIG. 2 is a breakdown drawing of the present invention.
Figure 4:
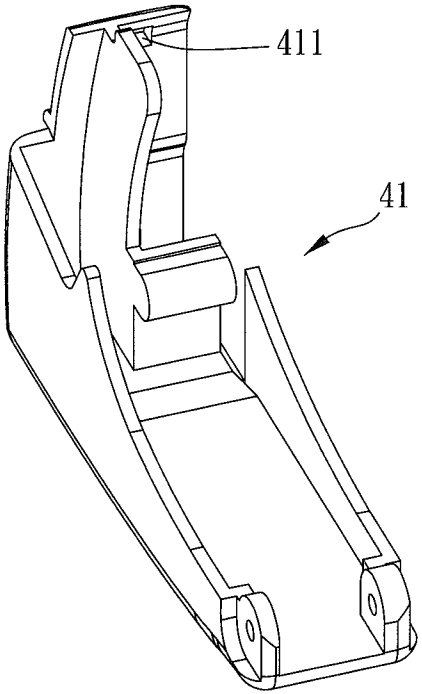
FIG. 4 is a stereogram showing a pressing member of the present invention at an other angle.
Figure 3:
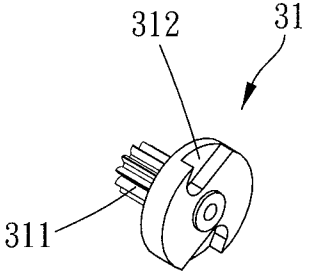
FIG. 3 is a stereogram showing a first driving member of the present invention at an other angle.
Figure 5:
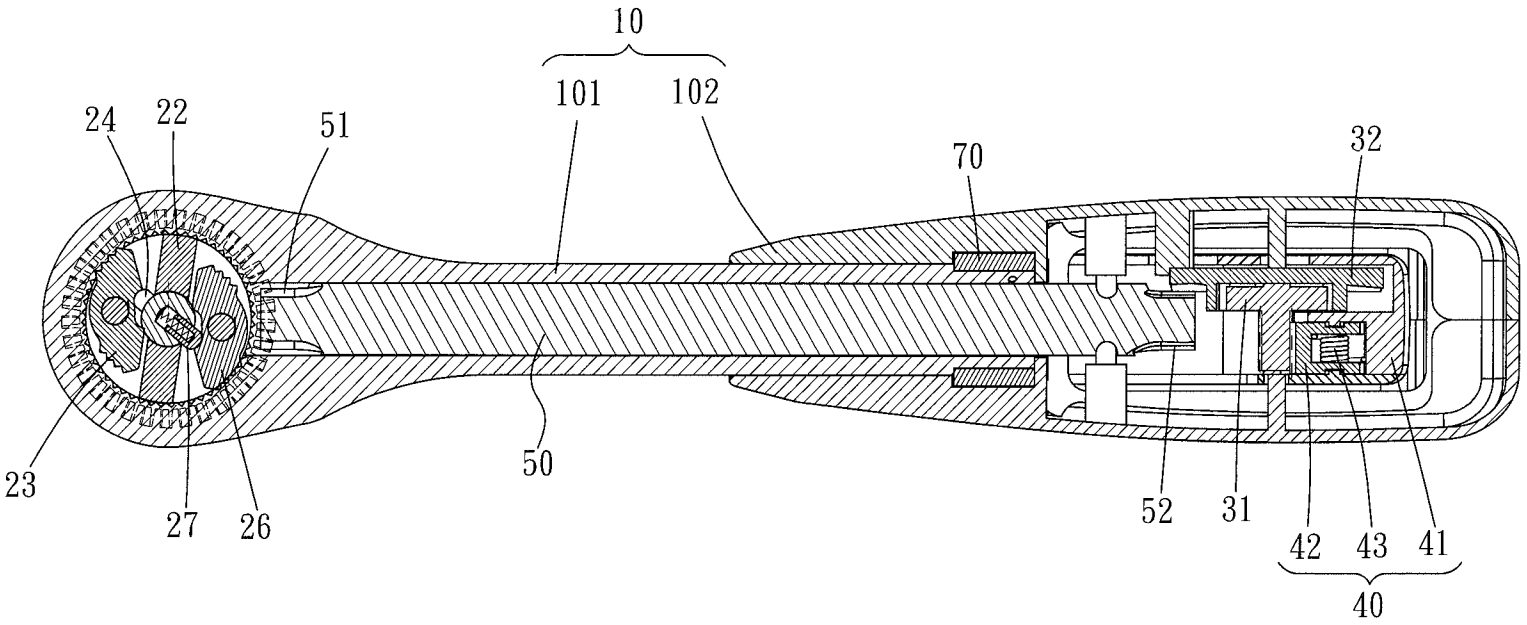
FIG. 5 is a profile of the present invention.
Figure 6:
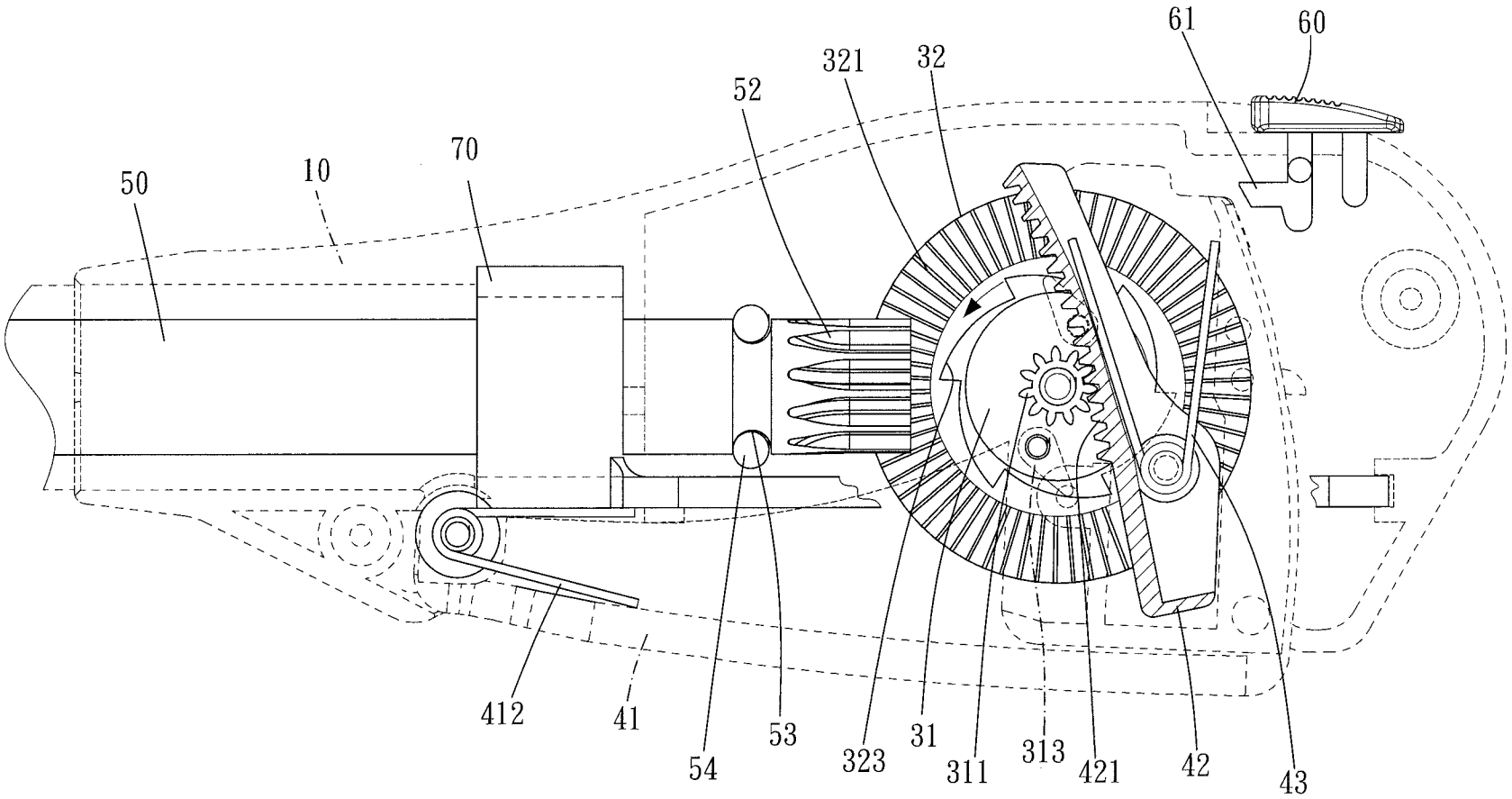
FIG. 6 and FIG. 7 are illustrations of operation of a driving assembly of the present invention.
Figure 7:
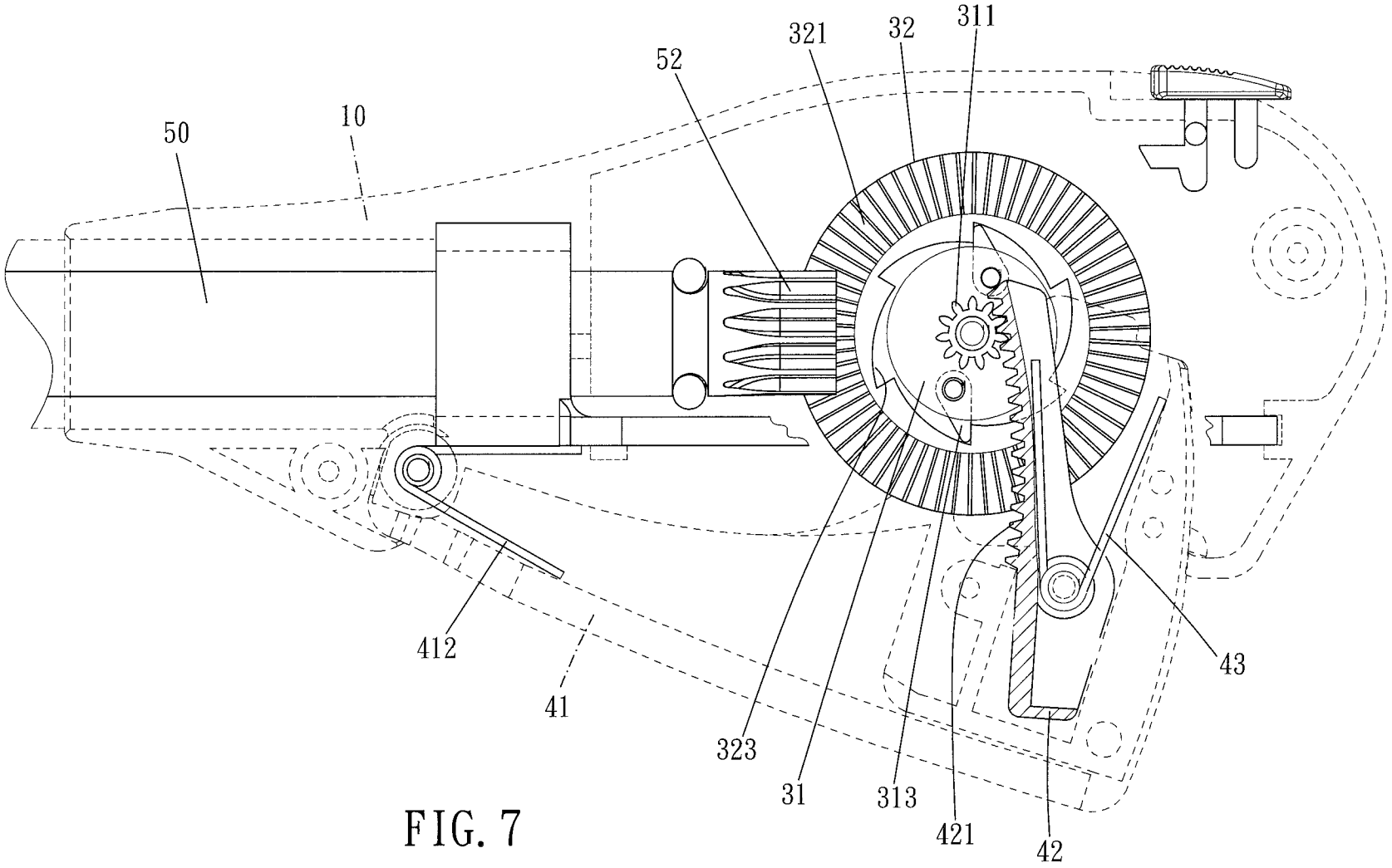
Figure 9:
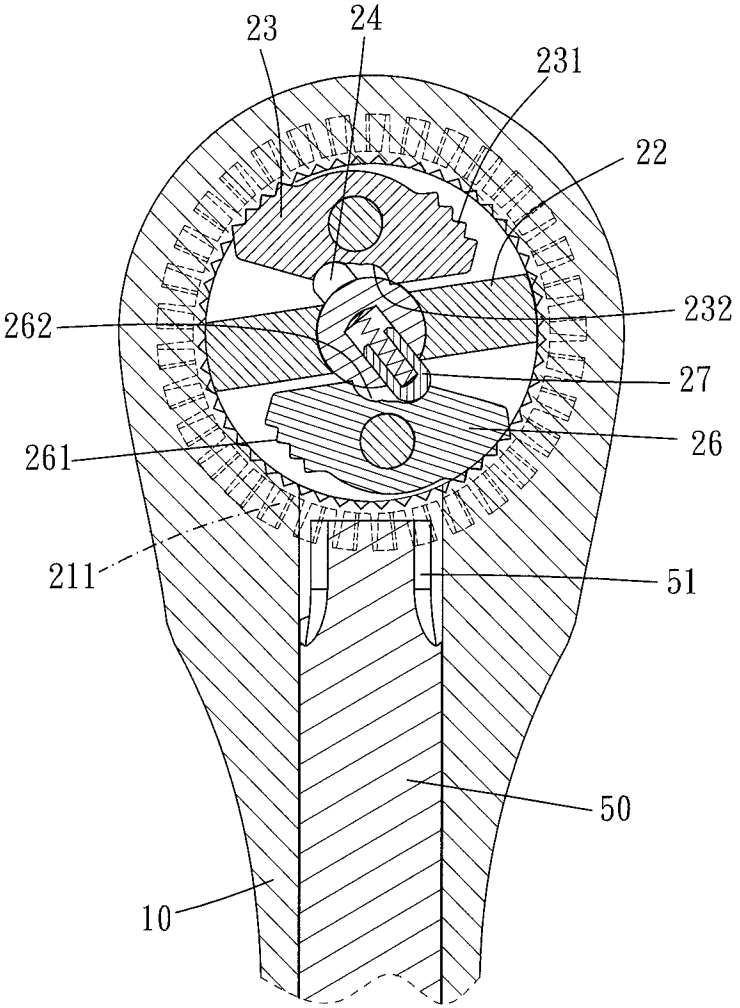
FIG. 8 and FIG. 9 are illustrations of operation of a follower assembly of the present invention.
Figure 8:
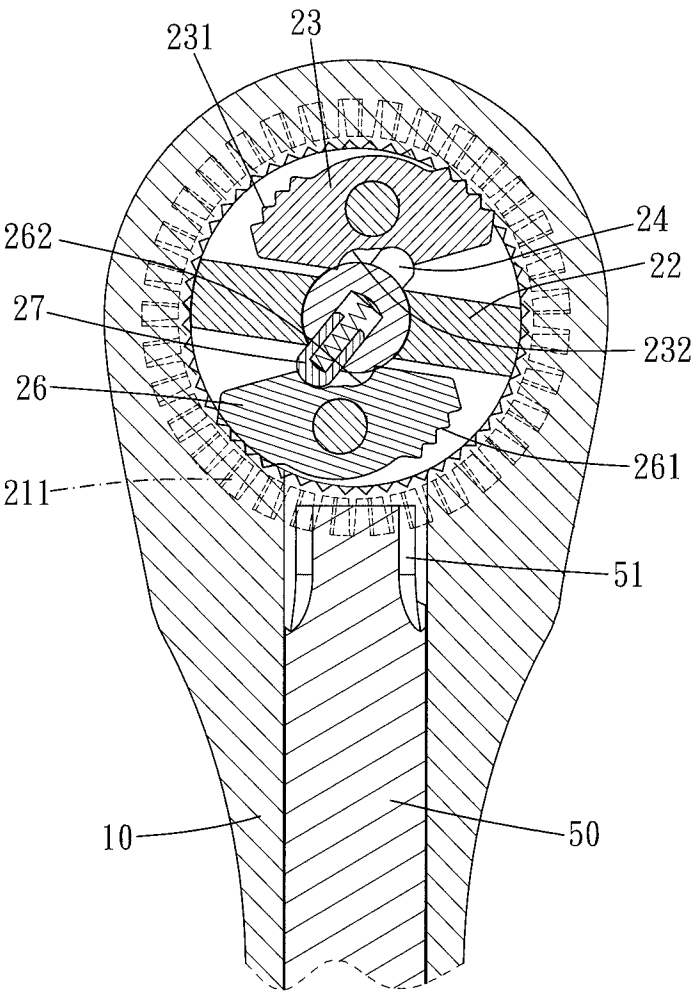

Please refer to FIG. 1 to FIG. 13, the driving tool of the present invention includes a housing 10,10', a follower assembly 20, a driving assembly 30,30', a pressing handle 40,40', and a toothed rod 50,50'.

The housing 10,10' has a first end and a second end opposite to the first end. The housing 10,10' has a follower zone 11 at the first end and a driving zone 12 at the second end. The follower assembly 20 is arranged in the follower zone 11 and includes at least one follower member 21. The at least one follower member 21 has a follower toothed portion 211 which is annular and is rotatably disposed on the housing 10,10'. The driving assembly 30,30' is arranged in the driving zone 12 and includes a first driving member 31,31', a second driving member 32,32', and a one-way rotation structure. The first driving member 31,31' has a first driving toothed portion 311,311' which is annular. The second driving member 32,32' has a second driving toothed portion 321,321' which is annular. The first driving member 31,31' and the second driving member 32,32' are rotatably disposed on the housing 10,10' co-axially. The first driving member 31,31' is connected to the second driving member 32,32' via the one-way rotation structure. When the first driving member 31,31' rotates toward a first direction, the first driving member 31,31' drives the second driving member 32,32' to rotate via the one-way rotation structure. When the first driving member 31,31' rotates toward a second direction opposite to the first direction, the one-way rotation structure prevents the second driving member 32,32' from being rotated by the first driving member 31,31'. The pressing handle 40,40' includes a driving toothed rack 421,421'. The driving toothed rack 421,421' is engaged with the first driving toothed portion 311,311' so that the first driving member 31,31' is driven to rotate by a movement of the pressing handle 40,40'. The toothed rod 50,50' is arranged in the housing 10,10' to be located between the follower zone 11 and the driving zone 12. The toothed rod 50,50' has a first transmission toothed portion 51 and a second transmission toothed portion 52,52' at two opposite ends thereof wherein the first transmission toothed portion 51 and the second transmission toothed portion 52,52' are both annular. Optionally, the second transmission toothed portion 52' can be formed on a toothed member sleeved onto the toothed rod 50'. The first transmission toothed portion is engaged with the follower toothed portion of the at least one follower member so that the toothed rod is able to drive the at least one follower member 21 to rotate. The second transmission toothed portion 52 is engaged with the second driving toothed portion 321 of the second driving member 32 so that the second driving member 32 is able to drive the toothed rod 50 to rotate.

In the present embodiment, a longitudinal direction is defined a line composed of the firs end and the second end of the housing 10,10'. The housing 10,10' further defines a vertical direction and a horizontal direction which are perpendicular to the longitudinal direction respectively. The at least one follower member 21 rotates about the vertical direction. The follower toothed portion 211 is disposed on a horizontal face of the at least one follower member 21. Each of the first driving member 31,31' and the second driving member 32,32' rotates about the horizontal direction. The first driving toothed portion 311,311' is formed on an outer circumferential face of the first driving member 31,31'. The second driving toothed portion 321,321' is formed on a vertical face of the second driving member 32,32'. Each of the first transmission toothed portion 51 and the second transmission toothed portion 52,52' is annularly formed on the toothed rod 50 about the longitudinal direction.

Specifically, the one-way rotation structure includes a recess 322,322' and at least one swing member 313 (two swing members 313 in the present embodiment). The recess 322,322' is formed on a face of the second driving member 32,32' facing the first driving member 31,31'. A plurality of notches 323,323' are formed on a lateral wall of the recess 322,322'. Each of the notches 323,323' has a depth increasing toward a circumferential direction and has a blocking wall at a deepest position thereof. Each of the blocking walls is parallel to a depth direction of the notch 323,323'. (The recess 322,322' and the notches 323,323' are fan-shaped.) The at least one swing member 313 is pivotally disposed on a face of the first driving member 31,31' facing the second driving member 32,32'. The at least one swing member 313 is received in the recess 322,322'. When the first driving member 31,31' rotates toward the first direction, a terminal end of the at least one swing member 313 enters one of the notches 323,323' to abut against the blocking wall to drive the second driving member 32,32' to rotate toward the first direction. Preferably, the first driving member 31 is formed with at least one restriction groove 312 on a face thereof facing the first driving member 32. The at least one swing member 313 is partially received in the at least one restriction groove 312 so that the range of swing of the at least one swing member 313 is restricted by the at least one restriction groove 312 for smoothly driving the second driving member 32 to rotate.

The follower assembly 20 includes two said follower members 21, a working head 22, two first detent members 23, two first positioning pins 24, and two first springs. Each of the follower members 21 is annular and has a first inner annular toothed portion 212 on an inner face. The follower toothed portions 212 of the two follower members 21 face each other. Each of the first detent members 23 is pivotally disposed on the working head 22 and has a first detent toothed portion 231 at each of two sides of the first detent member 23. Each of the first detent members 23 has two first positioning recesses 232 on a face thereof opposite to the two first detent toothed portions 231. Each of the two first positioning pins 24 is arranged between the working head 22 and one of the first positioning recesses 232 of one of the first detent members 23. Each of the first springs is biased between the working head 22 and one of the first positioning pins 24. Each of the first positioning pins 24 selectively abuts against one of the two first positioning recesses 232 of one of the first detent members 23 so that one of the two first detent toothed portions 231 is engaged with the first inner annular toothed portion 212 to drive the working head 22 to rotate or the first detent member 23 swings freely when the follower member 21 rotates. In other words, the two follower members 21 are engaged with two opposite sides of the first transmission toothed portion 51, so the two follower members 21 rotates reversely. Thus, when one of the follower members 21 drives the working head 22 to rotate, the other one follower member 21 is idling.

Preferably for another means of driving, the follower assembly 20 further includes two second detent members 26 (arranged at a same height but one of the first detent members 23 is below one of the second detent members 26, and the other one of the first detent members 23 is higher than the other one of the second detent members 26), two second positioning pins 27, and two second springs. The housing 10 is formed with a second inner annular toothed portion 111. Each of the second detent members 26 is pivotally disposed on the working head 22 and has a second detent toothed portion 261 at each of two sides of the second detent member 26. Each of the second detent members 26 has two second positioning recesses 262 on a face thereof opposite to the two second detent toothed portions 261. Each of the two second positioning pins 27 is arranged between the working head 22 and one of the second positioning recesses 262 of one of the second detent members 26. Each of the second springs is biased between the working head 22 and one of the second positioning pins 27. Each of the second positioning pins 27 selectively abuts against one of the two second positioning recesses 262 of one of the second detent members 26 so that one of the two second detent toothed portions 261 is engaged with the second inner annular toothed portion 111 to drive the working head 22 to rotate or the second detent member 26 swings freely when the housing 10 pivots. Specifically, the working head 22 has a working portion 221 and a rotation portion 222 at two ends thereof. The working portion 221 is adapted for connecting with a workpiece. The rotation portion 222 is adapted for switching each of the first positioning pins 24 to abut against which one of the first positioning recesses 232 and switching each of the second positioning pins 27 to abut against which one of the second positioning recesses 262 in order to change a direction of driving.

Figure 10:
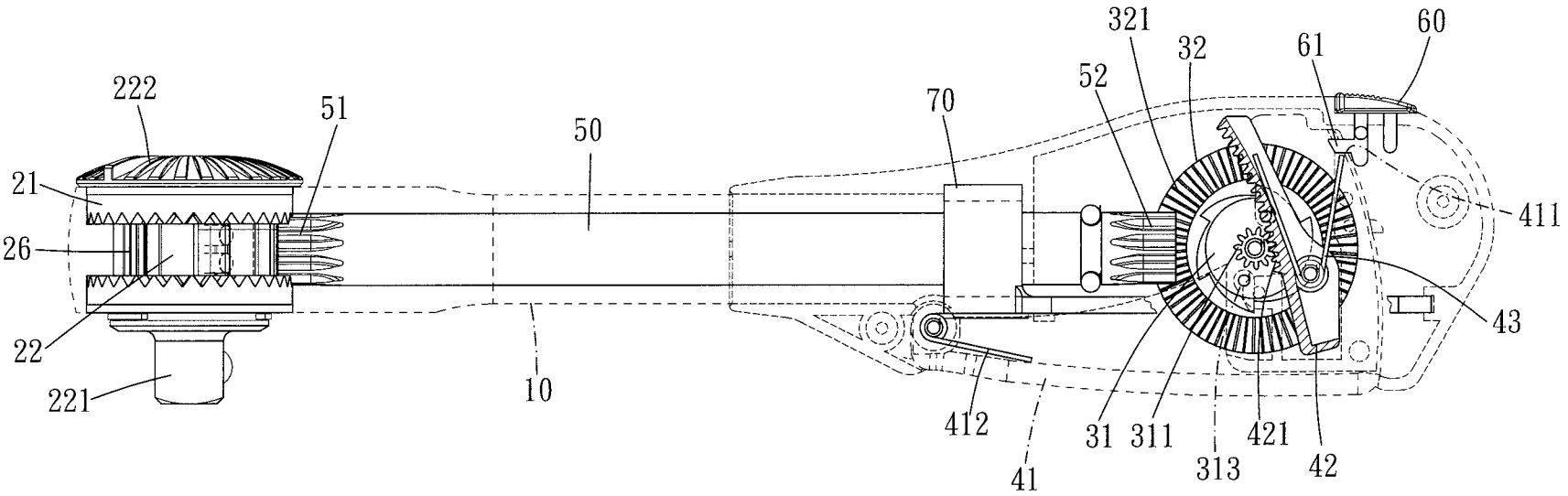
FIG. 10 is an illustration of the present invention.
Figure 11:
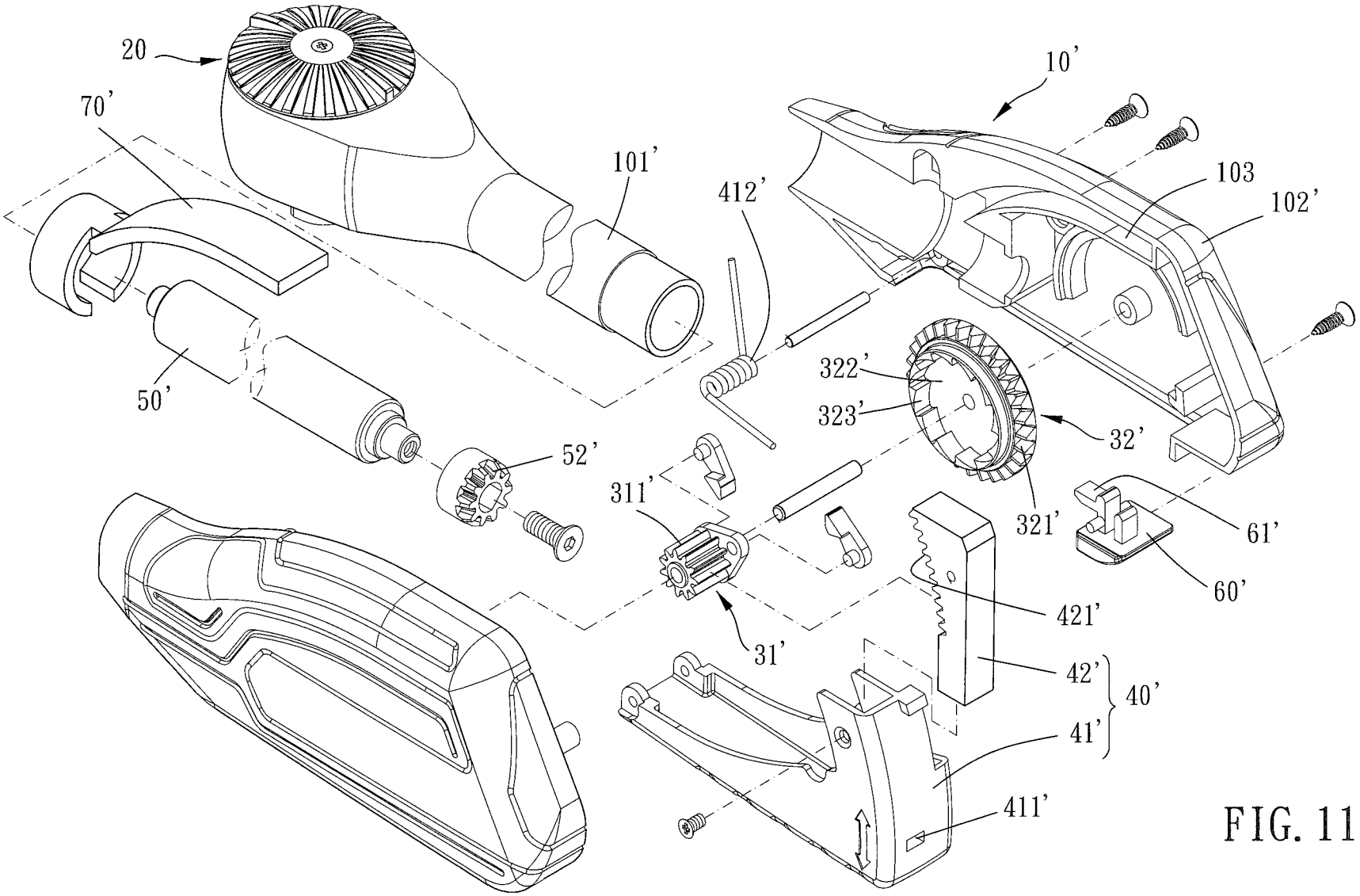
FIG. 11 is a breakdown drawing showing a second embodiment of the present invention.
Figure 12:
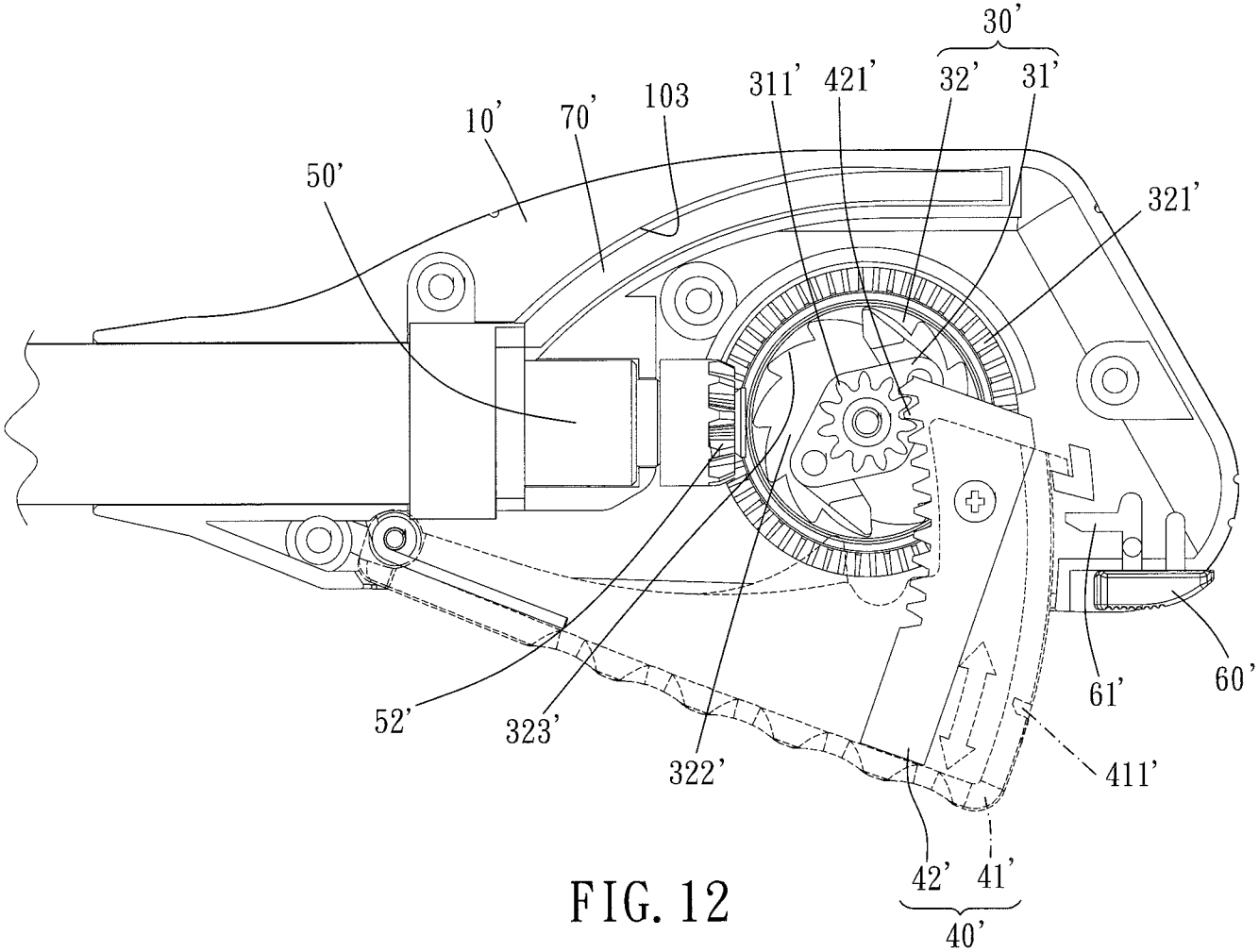
FIG. 12 is a profile showing a second embodiment of the present invention.
Figure 13:
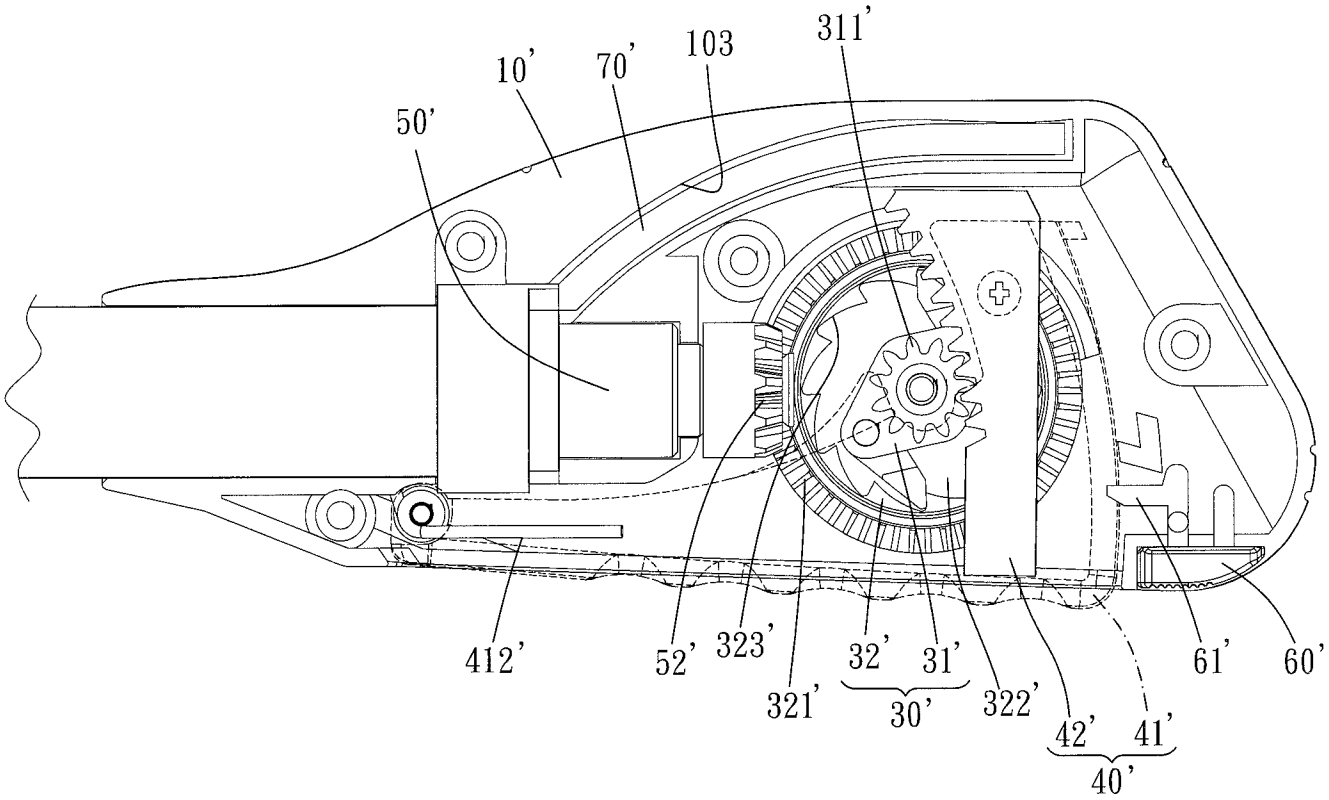
FIG. 13 is an illustration showing a second embodiment of the present invention.

Besides, the pressing handle 40,40' includes a pressing member 41,41', a toothed rack member 42,42', and an elastic member 43. The pressing member 41,41' is pivotally disposed on the housing 10,10'. (Preferably, a tension spring 412,412' is biased between the pressing member 41,41' and the housing 10,10' so that the pressing member 41,41' tends to move away from the housing.) The driving toothed rack 421,421' is arranged on the toothed rack member 42,42'. The toothed rack member 42,42' is pivotally disposed on the pressing member 41,41'. The elastic member 43 is biased between the pressing member 41,41' and the toothed rack member 42,42' so that the toothed rack member 42,42' tends to press the first driving member 31 to engage with the first driving member 31. If the reaction force from the workpiece overcomes the elasticity of the elastic member 43, the toothed rack member 42 moves backward to be not engaged with the first driving toothed portion 311 to result idling in order to prevent the teeth from damaging. The toothed rod 50 is formed with an annular groove 53 at an end thereof near the second driving member 32. Two restriction pins 54 are arranged at two sides of the toothed rod 50 to embed in the annular groove 53 respectively. Two ends of each of the restriction pins 54 are connected to the housing 10 respectively. Thereby, the toothed rod 50 is positioned in the housing 10. Besides, the driving tool further includes a positioning member 60,60'. The positioning member 60,60' is movably arranged on the housing 10,10'. The positioning member 60,60' has a positioning portion 61,61' extending into the housing 10,10'. The pressing member 41,41' is formed with a positioning hole 411,411' at a portion thereof inside the housing 10,10'. The positioning member 60,60' is movable to make the positioning portion 61,61' selectively insert into the positioning hole 411,411' to prevent the pressing member 41,41' from pivoting with respect to the housing 10,10'. Thereby, the pressing handle 40,40' can be prevented from accidentally pressing, as shown in FIG. 10 and FIG. 13.

The driving tool of the present invention further includes a reinforcement member 70,70'. The housing 10,10' is composed of a first part 101,101' and a second part 102,102' assembled together. The follower zone 11 is located at the first part 101,101'. The driving zone 12 is located at the second part 102,102'. An end of the reinforcement member 70,70' is connected to an end of the first part 101,101' closer to the second part 102,102'. An other end of the reinforcement member 70,70' is connected to an end of the second part 102,102' remote from the first part 101,101'. Specifically, the reinforcement member 70 includes an annular portion and a rectangular frame. The annular portion is sleeved onto a terminal end of the first part 101. The rectangular frame has a central axis parallel to the vertical direction and extends to an end of the second part 102 remote from the first part 101. The first driving member 31, the second driving member 32, and the toothed rack member 42 are surrounded by the rectangular frame. Due to the reinforcement member 70, the force may not concentrate on the intermediate section of the housing 10 but be dispersed to the terminal end of the housing 10 to prevent the housing 10 from damaging. In the second embodiment of the present invention, the reinforcement member 70' includes an annular portion and an extension portion. The annular portion is sleeved onto the terminal end of the first part. The extension portion extends into a receiving groove 103 of the housing 10'.

In use, when the user presses the pressing handle 40,40' for several times, the follower member 21 is driven to rotate by the toothed rack member 42,42', the first driving member 31,31', the second driving member 32,32', and the toothed rod 50,50'. Thereby, the working head 22 is driven to rotate continuously by the first detent member 23. Due to the one-way rotation structure, the second driving member 32,32' can be driven to rotate toward only a single direction though the driving toothed rack 421,421' is always engaged with the first driving toothed portion 311,311'. Besides, to change the direction of rotation, the rotation portion 222 can be used for switching. On the other hand, the second detent member 26 provides another means of driving. That is, the working head 22 can be driven by pivoting the housing 10,10' without pressing the pressing handle 40,40'.

Besides, when finishing using the driving tool, the user can press the pressing handle 40,40' into the housing 10,10' and slide the positioning member 60,60' to make the positioning portion 61,61' insert into the positioning hole 411, 411' of the pressing handle 40,40'. Thereby, the pressing handle 40,40' is received in the housing 10,10' to prevent from accidentally pressing. When the user wants to use the driving tool again, the user can slide the positioning member 60,60' reversely to make the positioning portion 61,61' leave the positioning hole 411,411' of the pressing handle 40. Thereby, the pressing handle 40,40' pivots to the position for use due to the tension spring 412,412'.

In conclusion, the driving tool of the present invention the driving tool of the present invention can drive the working head to rotate by simply pressing. In addition, another means of driving is prepared. Besides, the pressing handle can be stored to prevent from accidentally pressing or dust.

What is claimed is:

1. A driving tool, including:

a housing, having a first end and a second end opposite to the first end, the housing having a follower zone at the first end and a driving zone at the second end;

a follower assembly, arranged in the follower zone and including at least one follower member, the at least one follower member having a follower toothed portion which is annular and is rotatably disposed on the housing;

a driving assembly, arranged in the driving zone and including a first driving member, a second driving member, and a one-way rotation structure, the first driving member having a first driving toothed portion which is annular, the second driving member having a second driving toothed portion which is annular, the first driving member and the second driving member being rotatably disposed on the housing co-axially, the first driving member being connected to the second driving member via the one-way rotation structure; when the first driving member rotates toward a first direction, the first driving member driving the second driving member to rotate via the one-way rotation structure; when the first driving member rotates toward a second direction opposite to the first direction, the one-way rotation structure preventing the second driving member from being rotated by the first driving member;

a pressing handle, including a driving toothed rack, the driving toothed rack being engaged with the first driving toothed portion so that the first driving member is driven to rotate by a movement of the pressing handle;

a toothed rod, arranged in the housing to be located between the follower zone and the driving zone, the toothed rod having a first transmission toothed portion and a second transmission toothed portion at two opposite ends thereof wherein the first transmission toothed portion and the second transmission toothed portion are both annular, the first transmission toothed portion being engaged with the follower toothed portion of the at least one follower member so that the toothed rod is able to drive the at least one follower member to rotate, the second transmission toothed portion being engaged with the second driving toothed portion of the second driving member so that the second driving member is able to drive the toothed rod to rotate;

wherein a longitudinal direction is defined a line composed of the firs end and the second end of the housing, the housing further defines a vertical direction and a horizontal direction which are perpendicular to the longitudinal direction respectively, the at least one follower member rotates about the vertical direction, the follower toothed portion is disposed on a horizontal face of the at least one follower member, each of the first driving member and the second driving member rotates about the horizontal direction, the first driving toothed portion is formed on an outer circumferential face of the first driving member, the second driving toothed portion is formed on a vertical face of the second driving member, each of the first transmission toothed portion and the second transmission toothed portion is annularly formed on the toothed rod about the longitudinal direction;

wherein the one-way rotation structure includes a recess and at least one swing member, the recess is formed on a face of the second driving member facing the first driving member, a plurality of notches are formed on a lateral wall of the recess, each of the notches has a depth increasing toward a circumferential direction and has a blocking wall at a deepest position thereof, each of the blocking walls is parallel to a depth direction of the notch, the at least one swing member is pivotally disposed on a face of the first driving member facing the second driving member, the at least one swing member is received in the recess, when the first driving member rotates toward the first direction, a terminal end of the at least one swing member enters one of the notches to abut against the blocking wall to drive the second driving member to rotate toward the first direction.

2. The driving tool of claim 1, wherein the pressing handle includes a pressing member, a toothed rack member, and an elastic member, the pressing member is pivotally disposed on the housing, the driving toothed rack is arranged on the toothed rack member, the toothed rack member is pivotally disposed on the pressing member, the elastic member is biased between the pressing member and the toothed rack member so that the toothed rack member tends to press the first driving member to engage with the first driving member.

3. The driving tool of claim 2, further including a positioning member, the positioning member being movably arranged on the housing, the positioning member having a positioning portion extending into the housing, the pressing member is formed with a positioning hole at a portion thereof inside the housing, the positioning member being movable to make the positioning portion selectively insert into the positioning hole to prevent the pressing member from pivoting with respect to the housing.

4. The driving tool of claim 1, further including a reinforcement member, the housing being composed of a first part and a second part assembled together, the follower zone being located at the first part, the driving zone being located at the second part, an end of the reinforcement member being connected to an end of the first part closer to the second part, an other end of the reinforcement member being connected to an end of the second part remote from the first part.

5. The driving tool of claim 1, wherein the toothed rod is formed with an annular groove at an end thereof near the second driving member, two restriction pins are arranged at two sides of the toothed rod to embed in the annular groove respectively, two ends of each of the restriction pins are connected to the housing respectively.

6. The driving tool of claim 1, wherein the follower assembly includes two said follower members, a working head, two first detent members, two first positioning pins, and two first springs, each of the follower members is annular and has a first inner annular toothed portion on an inner face, the follower toothed portions of the two follower members face each other, each of the first detent members is pivotally disposed on the working head and has a first detent toothed portion at each of two sides of the first detent member, each of the first detent members has two first positioning recesses on a face thereof opposite to the two first detent toothed portions, each of the two first positioning pins is arranged between the working head and one of the first positioning recesses of one of the first detent members, each of the first springs is biased between the working head and one of the first positioning pins, each of the first positioning pins selectively abuts against one of the two first positioning recesses of one of the first detent members so that one of the two first detent toothed portions is engaged with the first inner annular toothed portion to drive the working head to rotate or the first detent member swings freely when the follower member rotates.

7. The driving tool of claim 6, wherein the follower assembly further includes two second detent members, two second positioning pins, and two second springs, the housing is formed with a second inner annular toothed portion, each of the second detent members is pivotally disposed on the working head and has a second detent toothed portion at each of two sides of the second detent member, each of the second detent members has two second positioning recesses on a face thereof opposite to the two second detent toothed portions, each of the two second positioning pins is arranged between the working head and one of the second positioning recesses of one of the second detent members, each of the second springs is biased between the working head and one of the second positioning pins, each of the second positioning pins selectively abuts against one of the two second positioning recesses of one of the second detent members so that one of the two second detent toothed portions is engaged with the second inner annular toothed portion to drive the working head to rotate or the second detent member swings freely when the housing pivots.

8. The driving tool of claim 6, wherein the working head has a working portion and a rotation portion at two ends thereof, the working portion is adapted for connecting with a workpiece, the rotation portion is adapted for switching each of the first positioning pins to abut against one of the first positioning recesses in order to change a direction of driving.

* * * * *